US008534482B2

(12) United States Patent
Tuunanen et al.

(10) Patent No.: US 8,534,482 B2
(45) Date of Patent: Sep. 17, 2013

(54) WASTE COLLECTION SYSTEM AND A METHOD FOR ASSEMBLING A WASTE COLLECTION SYSTEM

(75) Inventors: Mika Petri Juhani Tuunanen, Nurmijärvi (FI); Reino Pekka Kotro, Lahti (FI)

(73) Assignee: Hannoa Oy, Turku (FI)

( * ) Notice: Subject to any disclaimer, the term of this patent is extended or adjusted under 35 U.S.C. 154(b) by 135 days.

(21) Appl. No.: 13/175,922

(22) Filed: Jul. 4, 2011

(65) Prior Publication Data

US 2012/0168438 A1 Jul. 5, 2012

(30) Foreign Application Priority Data

Jul. 5, 2010 (EP) ..... 10168423

(51) Int. Cl.
*B65D 21/02* (2006.01)
*B65D 88/76* (2006.01)

(52) U.S. Cl.
USPC ..... 220/23.87; 220/23.88; 220/23.91; 220/484; 220/567.1; 220/908

(58) Field of Classification Search
USPC ..... 220/23.87, 23.88, 23.89, 23.91, 484, 220/567.1, 752, 908
See application file for complete search history.

(56) References Cited

U.S. PATENT DOCUMENTS 607,524 A * 7/1898 Reed ..... 220/484
2,528,056 A * 10/1950 Henry ..... 220/484
4,775,066 A * 10/1988 Keppeler ..... 220/484
2008/0203097 A1* 8/2008 Cardoso Cabral Martins da Silva et al. ..... 220/484
2009/0242565 A1* 10/2009 McLachlan ..... 220/484

FOREIGN PATENT DOCUMENTS

SE 509286 C2 1/1999

OTHER PUBLICATIONS

European Search Report for EP 10168423.1, Dec. 20, 2010.
European Patent Office Examination for EP 10168423.1, Dec. 20, 2010.

* cited by examiner

*Primary Examiner* — Anthony Stashick
*Assistant Examiner* — Madison L Poos
(74) *Attorney, Agent, or Firm* — Stiennon & Stiennon

(57) ABSTRACT

A waste collection system has an outer shell arranged at least partly underground. A waste container (6) is inserted partly into the outer shell, and has a frame mainly above the ground (8), and a top container (9) mainly above the ground and inside the frame. A bottom container is arranged mainly underground inside the outer shell. The waste container has a cover which opens to emptying the container and one or more filling openings arranged on the cover for introducing waste into the waste container. Lifting means are arranged on the frame, and are engaged by a lifting mechanism (20) so the waste container can be lifted out from the outer shell and emptied and returned. The frame has protrusion(s) (18, 19) toward the inside of the frame and the top container has corresponding recesses (21, 22) which attach the top container to the frame.

18 Claims, 6 Drawing Sheets

WASTE COLLECTION SYSTEM AND A METHOD FOR ASSEMBLING A WASTE COLLECTION SYSTEM

CROSS REFERENCES TO RELATED APPLICATIONS

This application is based on and claims the benefit of priority from European patent application No. 10168423.1, filed Jul. 5, 2010, the disclosure of which is incorporated by reference herein.

STATEMENT AS TO RIGHTS TO INVENTIONS MADE UNDER

FEDERALLY SPONSORED RESEARCH AND DEVELOPMENT

Not applicable.

BACKGROUND OF THE INVENTION

The invention relates to a waste collection system and a method for assembling a waste collection system. The invention especially relates to a new way of designing a waste container which is meant to be situated at least partly underground.

There are numerous solutions for waste collection in residential, commercial and public real estates. In order to save space on the ground a waste container can be situated at least partly underground. For example Swedish patent publication SE 509286 presents a waste collection arrangement where an outer shell with an open top is arranged partly underground and a waste container is inserted into the outer shell. The waste container comprises a cover with filling openings. The waste container also comprises engagement points suitable for e.g. a front loader truck by which the container can be lifted and emptied and returned into the outer shell.

Some prior art solutions function well in normal situations. Naturally there is always a need for finding a way for more efficient installing, more robust construction, easier use and emptying of the system. Environmental, aesthetical and hygienical properties of the waste collecting systems can always be improved.

SUMMARY OF THE INVENTION

The embodiments and advantages mentioned in this text are in suitable parts applicable to both the waste collection system and the method for assembling a waste collection system according to the invention, even if this is not always specifically mentioned.

One typical waste collection system according to the invention comprises:

- an outer shell with walls, a closed bottom and an opening at the top;
- a waste container to be inserted partly into the outer shell, the waste container comprising:
  - a frame to be arranged at least mainly above the ground;
  - a top container with open top and bottom parts, to be arranged at least mainly above the ground and inside the frame;
  - a bottom container with an open top part and a closed bottom part, to be arranged at least mainly underground inside the outer shell; whereby the top container and the bottom container comprise fastening means by which the bottom part of the top container is to be attached to the top part of the bottom container;
- a cover to be arranged openable on the waste container and arranged to be opened for emptying the container;
- one or more filling openings arranged on the cover for waste to be introduced into the waste container;
- lifting means arranged on the frame, suitable to be engaged by a lifting mechanism, e.g. forks of a front loader truck, by which the waste container can be lifted out from the outer shell and emptied and returned into the outer shell.

The frame comprises at least one protrusion towards the inside of the frame, and the top container comprises at least one corresponding recess in which said protrusion is to be fitted in order to attach the top container to the frame.

One typical method for assembling a waste collection system according to the invention comprises the following steps:

- arranging an outer shell with walls, a closed bottom and an opening at the top;
- preparing a waste container by attaching together a frame, a top container and a bottom container, whereby the top container has open top and bottom parts and the bottom container has an open top part and a closed bottom part by attaching the bottom part of the top container firmly to the top part of the bottom container;
- inserting the waste container partly into the outer shell, in such a way that
- the frame is arranged at least mainly above the ground;
- the top container with open top and bottom parts is arranged at least mainly above the ground and inside the frame;
- the bottom container is arranged at least mainly underground inside the outer shell;
- arranging a cover on the waste container in an openable way;
- arranging filling openings on the cover;
- arranging lifting means on the frame, suitable to be engaged by a lifting mechanism, e.g. forks of a front loader truck, by which the waste container can be lifted out from the outer shell and emptied and returned into the outer shell;
- attaching the top container to the frame by fitting at least one protrusion in the frame, which protrusion is directed towards the inside of the frame, into at least one corresponding recess in the top container.

In one aspect of the invention, the waste collection system comprises no substantial containers underground. This kind of system comprises:

- a waste container comprising:
- a frame to be arranged at least mainly above the ground;
- a top container with open top part and closed bottom part, to be arranged at least mainly above the ground and inside the frame;
- a cover to be arranged openable on the waste container and arranged to be opened for emptying the container;
- one or more filling openings arranged on the cover for waste to be introduced into the waste container;
- lifting means arranged on the frame, suitable to be engaged by a lifting mechanism, e.g. forks of a front loader truck, by which the waste container can be lifted, emptied and returned to the ground.

The frame comprises at least one protrusion towards the inside of the frame, and the top container comprises at least one corresponding recess in which said protrusion is to be fitted in order to attach the top container to the frame.

The invention is based on a surprising idea of locking the waste container firmly with the frame by simple and reliable protrusions in the frame and thereto fitting recesses in the waste container. In other words, mutually fitting protrusions and recesses are used to prevent the waste container from moving relative to the frame. Protrusions and corresponding recesses can be of any suitable number. The can be arranged e.g. on 2, 3 or 4 sides of the system and on different heights.

According to an embodiment of the invention, the outer shell is suitable to be arranged at least partly underground, and the method for assembling a waste collection system according to the invention comprises arranging the outer shell at least partly underground. The waste collection system according to the present invention can thus be either completely above the ground (i.e. on the ground), partly underground or almost fully underground.

According to an embodiment of the invention, the lifting means consist essentially of the at least one protrusion, i.e. the protrusions used for attaching the frame and the waste container to each other, are used also for lifting the waste container. In another embodiment of the invention, supporting structures of the frame, such as beams, are used as the protrusions.

In an embodiment of the invention the frame comprises at least two frame parts which can be detached from each other and attached to each other with suitable means, e.g. with a bolted flange joint. When such frame parts are detached from each other the protrusion can be removed from or inserted into the corresponding recess. When the frame parts are attached to each other the protrusion and recess are locked into each other, thereby locking the top container to the frame. The frame may be divided into two parts substantially symmetrically.

In an embodiment of the invention the lifting means comprise (i.e. the protrusions are in the form of) two elongated and mainly horizontal hollow beams that are mainly parallel with each other and suitable for forks of a forklift or similar. The hollow beams can be arranged on sides of the frame. In this case the top container is provided with corresponding two recesses formed on opposite sides of the top container. There could of course also be only one or more than two (such as three) similar hollow beams and corresponding recesses.

The waste container may be supported to the frame in various ways. In an embodiment of the invention the frame comprises a supporting collar on which collar the bottom container is at least partly supported and through which collar at least the bottom part of the bottom container is to be arranged. The collar may be arranged to have a diameter slightly smaller than the upper part of the bottom container. The collar may be arranged to receive most or at least a substantial part of the weight of the waste container. If the frame is formed of more than one detachable and attachable frame parts, the collar may also be divided in two detachable and attachable parts. Such collar parts may have suitable flanges to be bolted together.

In an embodiment of the invention the bottom part of the top container and the top part of the bottom container are to be firmly attached onto the supporting collar. E.g. the bottom part of the top container may rest on the collar and the top part of the bottom container may rest on the bottom part of the top container. This joint may be e.g. bolted onto the collar through bolt openings in the collar.

In an embodiment of the invention the bottom container is formed as a downwards tapering substantial cone, preferably as a truncated circular cone. A cone-shaped container is easy to move in to and out from the underground outer shell. A cone-shape also provides for the waste to compact itself by gravitation.

In an embodiment of the invention the bottom container is formed as a substantial circular cone which is cut near its upper end by at least one mainly vertical plane. If the frame has straight structures between which the waste container must be situated, a waste container formed like this fills the space inside the frame more effectively.

In an embodiment of the invention the frame comprises mainly vertical supporting columns;

supporting beams connecting the columns, which supporting beams are formed of the protrusions;

vertical panels between the columns arranged to substantially cover the beams.

The panels may be interchangeable so that the looks of the waste collecting system can customized.

In an embodiment of the invention at least some of the supporting beams of the frame are lifting means comprising two elongated mainly horizontal and mainly parallel hollow beams suitable for forks of a forklift, e.g. forks of a front loader truck. At least one end of such hollow beams opens outside the frame at the mainly vertical supporting columns. In case the horizontal cross section of the frame is a substantial rectangle the mainly vertical supporting columns may be situated on the corners of the frame. In an embodiment the vertical supporting columns are rounded on the outer corners of the frame. If the openings for the forks of the forklift are on these rounded corners, the operator can have a good visual contact on both openings.

The cover, top container, bottom container and outer shell may be made of any suitable material, e.g. various plastics such as polyethene (PE) or composite materials. The frame can be made of any suitable material. The columns, the supporting beams and the panels can be made of steel, e.g. stainless steel.

The bottom part of the top container and the top part of the bottom container may have a substantially similar form to ease their attachment together. E.g. they can both have a round opening with substantially the same diameter. The top container may be attached to the bottom container e.g. by bolts, glue, welding or any other known way of attaching. The seam between the top container and the bottom container may be made substantially liquid tight.

In the following some possible measurements (in millimeters, mm) are given for o components of a waste collection system. These measurements are possible e.g. for a system comprising a frame, a top container and an outer shell all having a horizontal cross section formed as a substantial rectangle and a bottom container formed as a substantial circular cone:

Frame and top container: length and width 1000-3000 mm or 1500-2500 mm; height 500-2000 mm or 800-1500 mm.

Bottom container: upper part diameter 1000-3000 mm or 1500-2500 mm; bottom part diameter: 500-2500 mm or 1000-2000 mm; height 500-2500 mm or 1000-2000 mm.

Outer shell: length and width 1000-3500 mm or 1800-2700 mm; height 1000-2500 mm or 1500-2000 mm.

The cover may be hinged to the frame or the top container. It can be locked so that it opens automatically when the waste container is tipped over a certain threshold angle to allow easy emptying.

The filling openings arranged on the cover may be furnished with openable lids. Lids may be furnished with a lock. The lid may be connected to the cover via an opening system, which comprises an opening assisting apparatus. The opening assisting apparatus may comprise mechanical components such as a spring or force producing components such as an electric motor or pneumatic cylinder. The opening assisting apparatus may be automatically actuated to open the lid e.g.

when the user pushes a button or activates a handle e.g. on the lid. The opening assisting apparatus may also automatically close the lid when the user pushes a button or activates a handle e.g. on the lid.

The present invention provides various advantages. Emptying of the waste container is done swiftly, safely and cost effectively e.g. by a front loader truck. Cone-shaped structure of the cone container forces the waste to compact itself. Being situated under ground level and furnished with its heat insulating air layer between the waste container and the outer shell the temperature of the waste in the system can be kept relatively stable. Temperature is kept low in the summer whereby the system can be kept odor free. In winter weather the underground container is capable of sustaining above freezing temperatures thereby preventing unwanted freezing of the waste material. Both the waste container and the outer shell can be made substantially liquid-tight, making any leakages practically impossible.

It is possible to arrange the waste collection system without any substantial underground waste containers. In this case there is no need for an outer shell or separate top and bottom containers. The frame and the waste container inside it are locked by protrusions and recesses as described above.

It is an object of the present invention to reduce or even to eliminate e.g. the above-mentioned problems appearing in the prior art.

An object of the present invention is especially to provide a waste collection system which is reliable and easy to use, cost efficient, and easy to assemble.

Further objects, features and advantages of the invention will be apparent from the following detailed description when taken in conjunction with the accompanying drawings.

BRIEF DESCRIPTION OF THE DRAWINGS

The invention is described below in more detail with reference to the enclosed schematic drawings.

DESCRIPTION OF THE PREFERRED EMBODIMENTS

For the sake of clarity, in the following the same reference numbers may be used for corresponding components of different embodiments.

Figure 1:
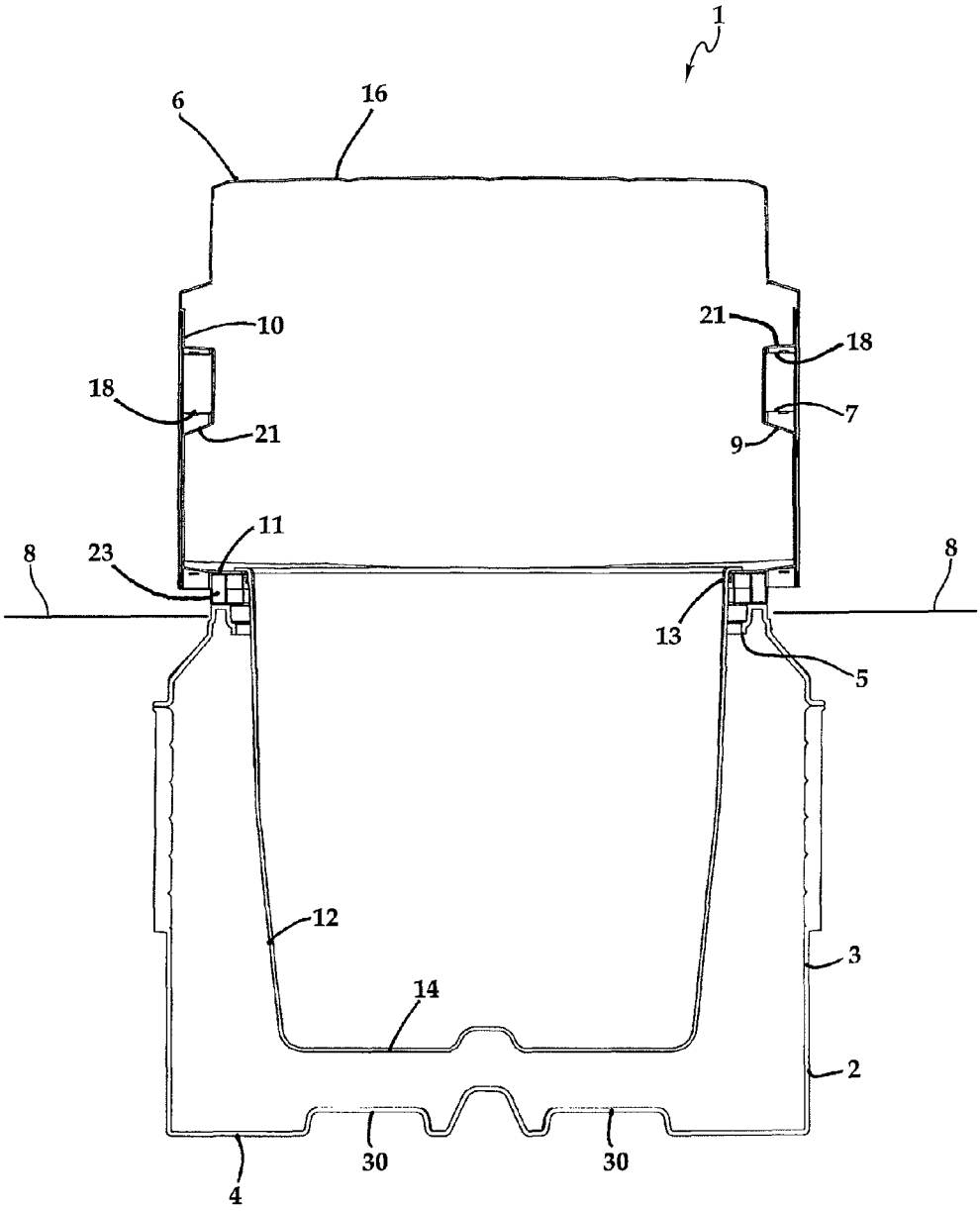
FIG. 1 shows a vertical cross section of an embodiment of a waste collection system according to the invention.
Figure 2:
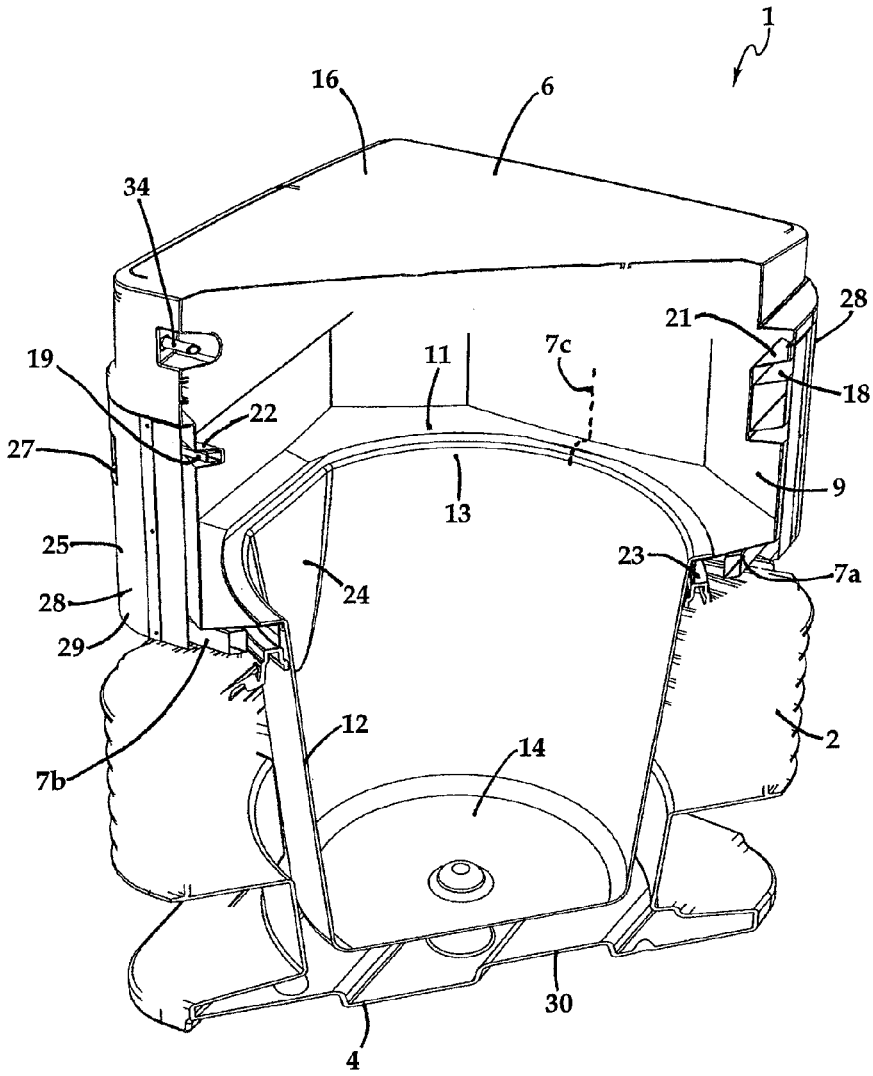
FIG. 2 shows a partly cut perspective view of an embodiment of a waste collection system according to the invention.

FIGS. 1 and 2 present a waste collection system 1, which comprises an outer shell 2 with walls 3, a closed bottom 4 and an opening 5 at the top. The outer shell is situated mostly under the ground level 8. A waste container 6 is inserted partly into the outer shell 2. The waste container 6 comprises three main parts, i.e. a frame 7, a top container 9 and a bottom container 12. The frame 7 is situated on the outer shell 2, above the ground 8. The top container 9 has an open top part 10 and an open bottom part 11. The top container 9 is arranged mainly inside the frame and above the ground 8. The cone shaped bottom container 12 has an open top part 13 and a closed bottom part 14. The bottom container 12 is arranged at least mainly inside the outer shell, i.e. underground. The frame comprises a supporting collar 23 through which circular collar the bottom container is arranged. The bottom part 11 of the top container and the top part 13 of the bottom container both comprise a circular opening, with approximately the same diameter as the supporting collar. The edges of these circular openings are attached firmly to each other and onto the supporting collar 23, e.g. with bolts (not shown). Recesses 30 suitable for forks of a fork lift or similar are formed at the bottom of the outer shell.

The horizontal cross section of the frame 7 is a near rectangle. As shown in FIG. 2, the frame 7 comprises mainly vertical supporting columns 25 on the corners 28 of the frame, supporting beams 18, 19 connecting the columns and vertical panels 26 between the columns. The panels 26 substantially cover the beams. Supporting columns are rounded on the outer corners 29 of the frame. Supporting beams 18 and 19 form protrusions towards the inside of the frame. The top container comprises corresponding recesses 21 and 22 in which said protrusions are fitted. Thereby the top container 9 is firmly attached to the frame 7.

The frame 7 is divided along a substantially vertical plane into two substantially symmetrical frame parts 7*a* and 7*b*. The frame parts 7*a* and 7*b* and border 7*c* between them are shown only schematically in FIG. 2. The frame parts 7*a* and 7*b* are detachable from each other allowing the removal of the beams 18 and 19 from the recesses 21 and 22. On the other hand, the frame parts 7*a* and 7*b* are also attachable to each other allowing fitting the beams 18 and 19 into the recesses 21 and 22 thereby locking the top container to the frame.

Figure 3:
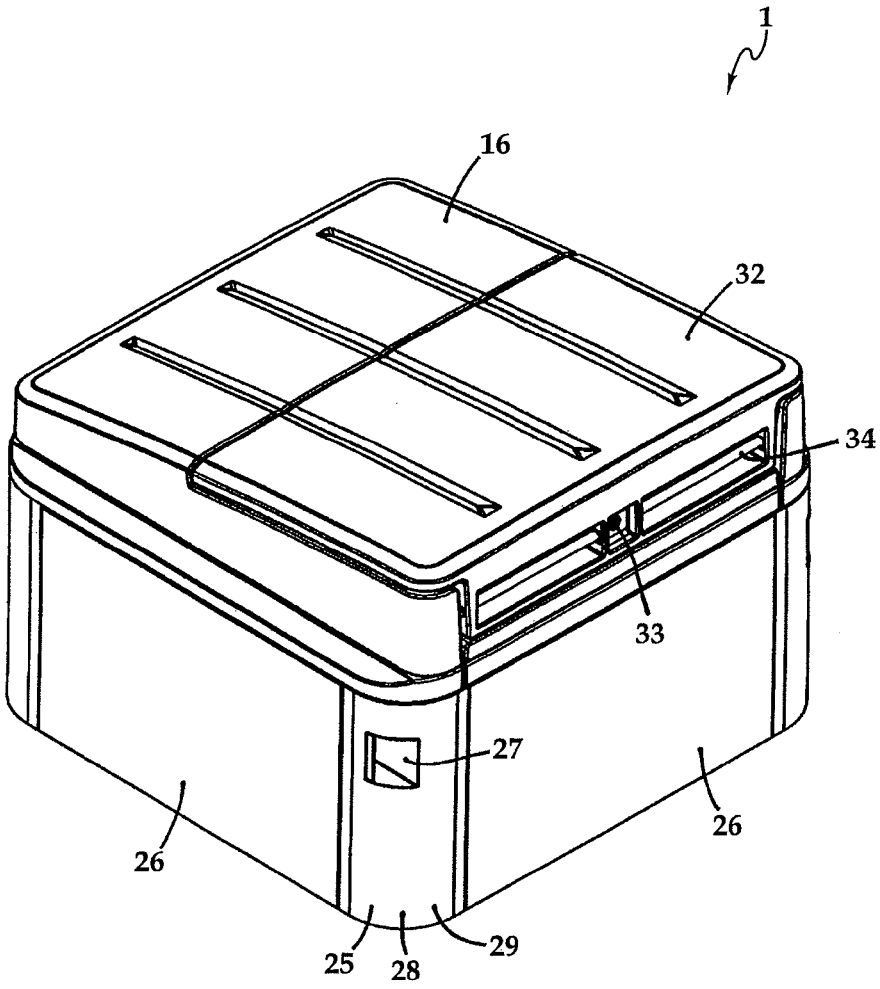
FIG. 3 shows a perspective view of an embodiment of the invention.
Figure 4:
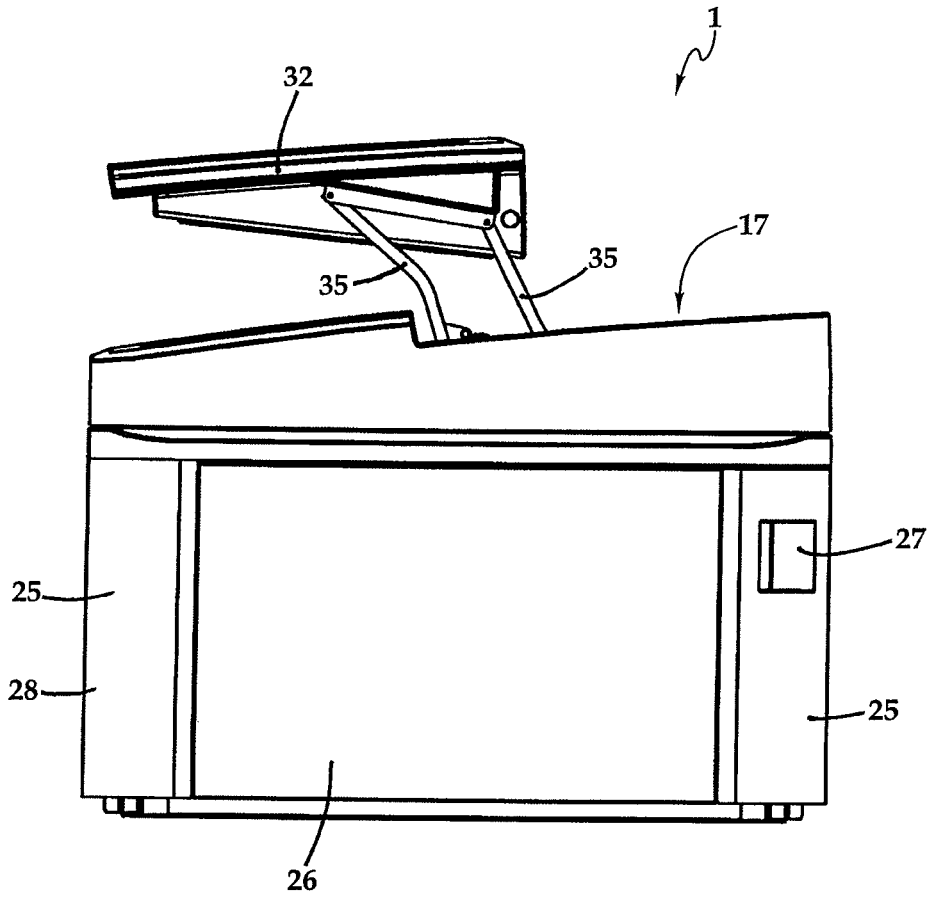
FIG. 4 shows a side view of the embodiment of FIG. 3.
Figure 6:
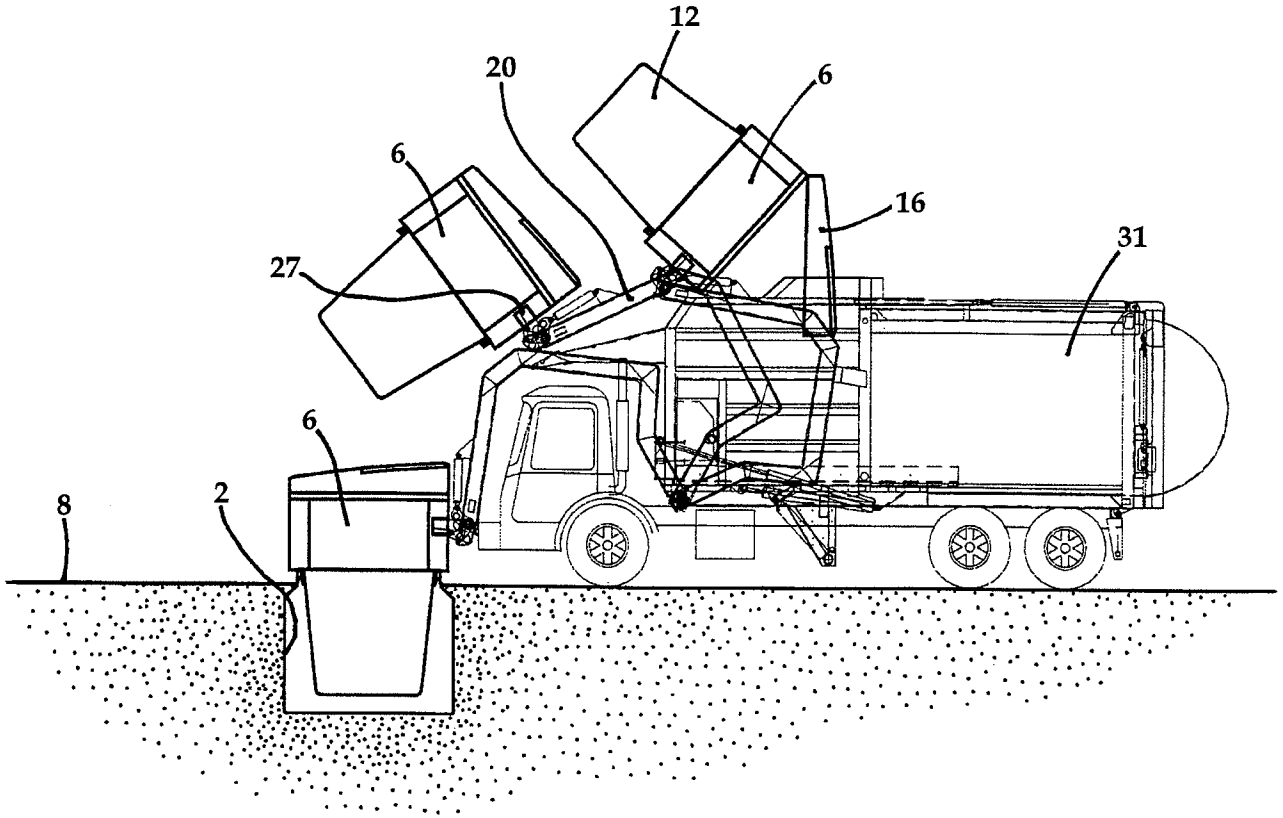
FIG. 6 shows a front loader truck emptying the system according to the invention.

FIGS. 3 and 4 show those parts of a waste collection system which are situated above the ground level in use normal situation. A cover 16 is arranged on the frame. The cover is hinged to the frame 7 and arranged to be opened only when emptying the container, as shown in FIG. 6. A filling opening 17 is arranged on the cover through which opening 17 waste can be thrown into the waste container 6. The filling opening 17 is covered by an openable lid 32. The lid can be locked with a lock 33, as shown in FIG. 3. When not locked, the lid can be opened by engaging a handle bar 34. When the handle bar is engaged, a spring (not shown) assists in opening the lid via hinged supports 35 in to the open position shown in FIG. 4. The lid 32 can be closed by pushing it back down to its closed position of FIG. 3.

The two elongated mainly horizontal and mainly parallel supporting beams 18 are hollow. Ends 27 of each of the hollow beams open outside the frame at the mainly vertical supporting columns 25. The beams are formed suitable to be engaged by for forks of a forklift 20 in a front loader truck 31. The waste container can be lifted out from the outer shell and emptied and returned into the outer shell, as shown in FIG. 6.

Figure 5:
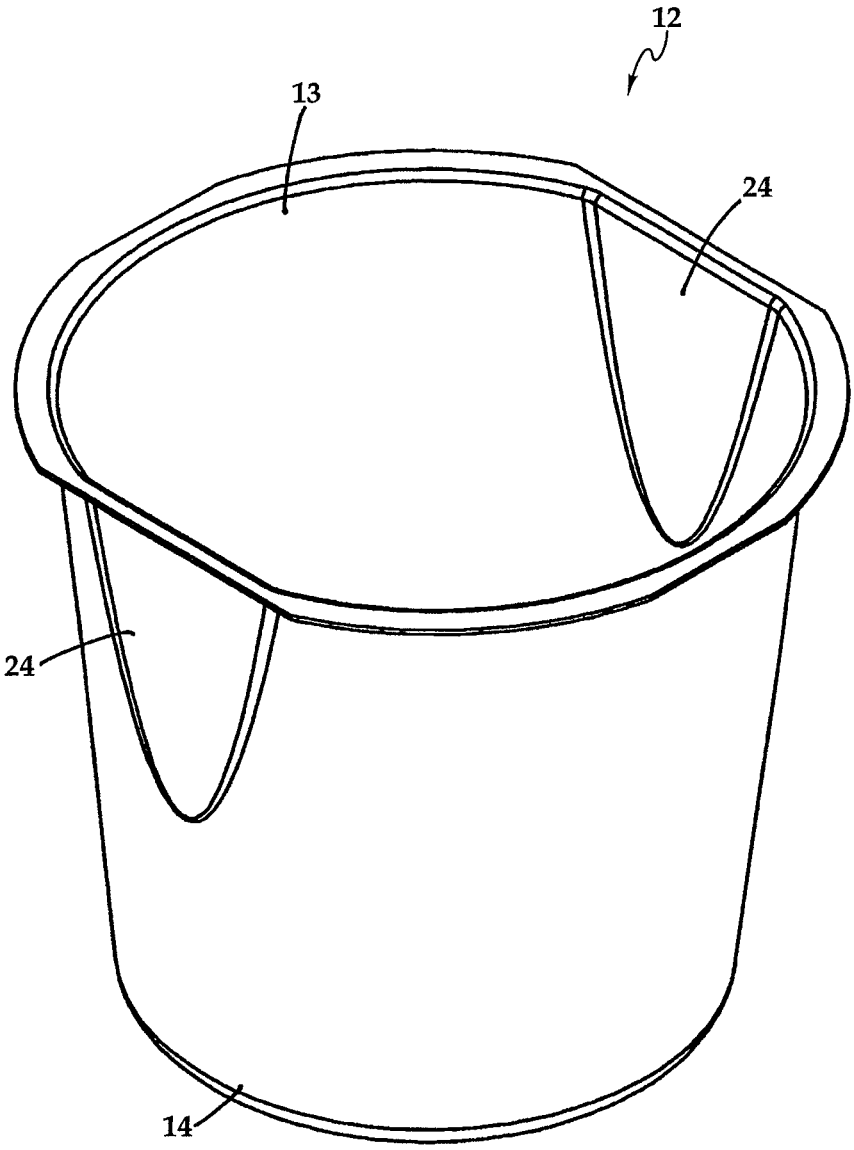
FIG. 5 shows a bottom container according to the invention.

FIG. 5 shows a bottom container 12 formed as a downwards tapering truncated circular cone. The cone shape is cut near its upper end on both sides by two mainly vertical planes 24.

Only some advantageous embodiments of the invention are shown in the figures. The figures do not separately disclose all facts of secondary importance regarding the main idea of the invention, known as such or obvious as such for a person skilled in the art. It is apparent to a person skilled in the art that the invention is not limited exclusively to the examples described above, but that the invention can vary within the scope of the claims presented below. The dependent claims present some possible embodiments of the invention, and they are not to be considered to restrict the scope of protection of the invention as such.

We claim:

1. A waste collection system, comprising:

an outer shell with walls, having a closed bottom and a top, portions of the top forming an opening;

a waste container insertable partly into the outer shell, the waste container comprising:

a frame, defining an inside, wherein portions of the frame define at least one protrusion(s) towards the inside of the frame;

a top container with an open top part and an open bottom part, the top container arranged at least mainly inside the frame, and having at least one recess into which the at least one protrusion of the frame extends so as to attach the top container to the frame;

a bottom container with an open top part and a closed bottom part positionable inside the outer shell;

wherein the top container and the bottom container are connected by fastener so that the bottom part of the top container is attached to the top part of the bottom container;

a cover openably mounted on the waste container so that when the cover is open the waste container can be emptied, wherein portions of the cover form at least one filling opening arranged on the cover for introduced waste into the waste container; and at least one lifting structure arranged on the frame, suitable to be engaged by a lifting mechanism by which the waste container can be lifted out from the outer shell and emptied and returned into the outer shell.

2. The waste collection system of claim 1 wherein the frame and the top container are arranged at least mainly above ground level and the bottom container is arranged at least mainly underground.

3. The waste collection system of claim 1 wherein the at least one lifting structure consists essentially of the at least one protrusion.

4. The waste collection system of claim 1 wherein the at least one lifting structure comprises at least two lifting structures formed by at least two protrusions in the form of two elongated and mainly horizontal hollow beams that are mainly parallel with each other and suitable to receive forks of a forklift, and wherein the at least one recess is at least two corresponding recesses, and the hollow beams are fitted into said corresponding recesses which are formed on opposite sides of the top container.

5. The waste collection system of claim 1 wherein the frame has at least two frame parts which are detachable from each other allowing the removal of the at least one protrusion and the at least one recess from each other, and attachable to each other allowing fitting together of the at least one protrusion in the at least one recess to firmly attach the top container to the frame.

6. The waste collection system of claim 1 wherein the frame has a supporting collar on which the bottom container is supported and through which collar at least the bottom part of the bottom container extends.

7. The waste collection system of claim 6 wherein the bottom part of the top container and the top part of the bottom container are firmly attached onto the supporting collar.

8. The waste collection system of claim 1 wherein the bottom container is formed as a downwards tapering cone.

9. The waste collection system of claim 8 wherein the bottom container is formed as a circular cone which is cut near its upper end by at least one mainly vertical plane.

10. The waste collection system of claim 1 wherein the bottom container is formed as a truncated circular cone.

11. The waste collection system of claim 1 wherein the frame comprises:

supporting columns which are arranged mainly vertical;

supporting beams connecting the columns, which supporting beams are formed of the protrusions; and vertical panels between the columns arranged to substantially cover the beams.

12. The waste collection system of claim 11 wherein at least some of the supporting beams of the frame are shaped as two hollow beams suitable for forks of a forklift, the two hollow beams are elongated mainly horizontal and mainly parallel and at least one end of each of the two hollow beams opens outside the frame at the supporting columns.

13. The waste collection system of claim 11 wherein the support beams of the frame have horizontal cross sections which are substantially a rectangle and wherein the supporting columns are on outer corners defined by the frame.

14. The waste collection system of claim 11 wherein the supporting columns are on outer corners defined by the frame and the supporting columns are rounded on said outer corners.

15. A method for assembling a waste collection system, the method comprising the steps of:

placing an outer shell mainly underground, the outer shell having walls, a closed bottom, and a top, with portions of the outer shell defining an opening at the top;

preparing a waste container by attaching together a frame defining an inside, a top container, and a bottom container, the top container having an open top part and an open bottom part, and the bottom container having an open top part and a closed bottom part, the frame, the top container and the bottom container being joined by attaching the bottom part of the top container to the top part of the bottom container and arranging the top container inside the frame;

mounting a cover on the waste container so the cover can be opened;

providing filling openings on the cover;

arranging lifting means on the frame, suitable to be engaged by a lifting mechanism by which the waste container can be lifted out from the outer shell and emptied and returned into the outer shell;

inserting the waste container partly into the outer shell, in such a way that the top container is arranged at least mainly above ground level, and the bottom container is arranged at least mainly underground inside the outer shell; and wherein the step of attaching the frame to and mainly inside the top container is by fitting at least one protrusion in the frame, which protrusion is directed toward the inside of the frame into at least one corresponding recess in the top container.

16. The method of claim 15 further comprising assembling the frame from at least two frame parts, the at least two frame parts comprising a protrusion directed towards the inside of the frame; and attaching the at least two frame parts to each other and thereby fitting the protrusion in the frame parts into at least one corresponding recess in the top container.

17. A method for assembling a waste collection system, the method comprising the steps of:

placing an outer shell at ground level, the outer shell having walls, a closed bottom, and a top, with portions of the outer shell defining an opening at the top;

preparing a waste container by attaching together a frame defining an inside, a top container, and a bottom container, the top container having an open top part and an open bottom part, and the bottom container having an open top part and a closed bottom part, the frame, the top container and the bottom container being joined by attaching the bottom part of the top container to the top part of the bottom container and arranging the top container inside the frame;

mounting a cover on the waste container so the cover can be opened;

providing filling openings on the cover;

arranging lifting means on the frame, suitable to be engaged by a lifting mechanism by which the waste container can be lifted out from the outer shell and emptied and returned into the outer shell;

inserting the waste container partly into the outer shell; and wherein the step of attaching the frame to and mainly inside the top container is by fitting at least one protrusion in the frame, which protrusion is directed toward the inside of the frame, into at least one corresponding recess in the top container.

18. The method of claim 17 further comprising assembling the frame from at least two frame parts, the at least two frame parts comprising a protrusion directed towards the inside of the frame; and attaching the at least two frame parts to each other and thereby fitting the protrusion in the frame parts into at least one corresponding recess in the top container.

* * * * *